US008438978B2

(12) United States Patent
Sullivan et al.

(10) Patent No.: US 8,438,978 B2
(45) Date of Patent: May 14, 2013

(54) PROJECTILE WITH A MULTI-SPECTRAL MARKING PLUME

(75) Inventors: Kevin Michael Sullivan, Kennebunk, ME (US); Darlene Justesen, Beverly, MA (US); Perry Justesen, Beverly, MA (US)

(73) Assignee: Rheinmetall Waffe Munition GmbH, Unterleuss (DE)

( * ) Notice: Subject to any disclaimer, the term of this patent is extended or adjusted under 35 U.S.C. 154(b) by 215 days.

(21) Appl. No.: 12/853,546

(22) Filed: Aug. 10, 2010

(65) Prior Publication Data

US 2012/0255458 A1 Oct. 11, 2012

Related U.S. Application Data

(60) Provisional application No. 61/274,018, filed on Aug. 11, 2009.

(51) Int. Cl.
*F42B 12/40* (2006.01)

(52) U.S. Cl.
USPC ..... 102/513; 102/444; 102/498; 102/529

(58) Field of Classification Search ..... 102/513, 102/502, 529, 498, 444
See application file for complete search history.

(56) References Cited

U.S. PATENT DOCUMENTS

| | | | | |
|---|---|---|---|---|
| 3,494,285 | A | 2/1970 | Doris, Jr. et al. | |
| 5,348,690 | A | 9/1994 | Cohen | |
| 5,565,649 | A | 10/1996 | Tougeron et al. | |
| 5,654,524 | A | 8/1997 | Saxby | |
| 5,661,257 | A | 8/1997 | Nielson et al. | |
| 6,619,211 | B1 | 9/2003 | Haeselich | |
| 7,055,438 | B1 | 6/2006 | Manole | |
| 8,297,187 | B2 * | 10/2012 | Sullivan | 102/213 |
| 2006/0231179 | A1 | 10/2006 | Guindon et al. | |
| 2007/0119329 | A1 | 5/2007 | Haeselich | |
| 2008/0053330 | A1 | 3/2008 | Haeselish | |
| 2011/0017091 | A1 * | 1/2011 | Cranor et al. | 102/513 |
| 2011/0079164 | A1 * | 4/2011 | Broden et al. | 102/444 |
| 2012/0067242 | A1 * | 3/2012 | Shin et al. | 102/364 |
| 2012/0204749 | A1 * | 8/2012 | Sullivan | 102/382 |
| 2012/0227614 | A1 * | 9/2012 | Sullivan | 102/513 |

FOREIGN PATENT DOCUMENTS

| | | | |
|---|---|---|---|
| EP | 1184494 | B1 | 5/2000 |
| WO | 2008107215 | A1 | 9/2008 |

* cited by examiner

*Primary Examiner* — James Bergin
(74) *Attorney, Agent, or Firm* — Karl F. Milde, Jr.; Eckert Seamans Cherin & Mellott, LLC

(57) ABSTRACT

A training ammunition projectile has a projectile body comprising a head with a frangible ogive designed to burst when the projectile strikes a target. One or more marking agents, disposed in the head for marking the position of the target upon its release when the ogive has burst, include 1) chemiluminescent components, disposed in separate frangible compartments, which mix and react chemically with each other when the compartments break up on setback, causing the mixed components to luminesce, and/or (2) a low density, fine, dry powder material disposed in the head and designed to create a plume, both for marking the target when the projectile strikes the target. A dry thermal material, disposed in a separate compartment in the head and designed to be exposed to oxygen or air upon setback, due to the initial acceleration and the centrifugal forces, produce an exothermic reaction and emit heat during flight of the projectile, thereby to increase the temperature of the marking agents during flight and provide an Infrared marking signature when the projectile strikes the target.

9 Claims, 4 Drawing Sheets

PROJECTILE WITH A MULTI-SPECTRAL MARKING PLUME

CROSS-REFERENCE TO RELATED APPLICATION

This application claims priority from Provisional Patent Application No. 61/274,018, filed Aug. 11, 2009.

BACKGROUND OF THE INVENTION

The present invention relates to the field of practice ammunition and, more specifically, to an ammunition projectile that can mark its point of impact both by day and by night.

Military forces currently use a wide array of technologies to detect and identify targets and adjust fire. Traditionally, military forces have used pyrotechnic devices in training ammunition allowing gunners to mark targets, but these pyrotechnic devices naturally result in unexploded ordnance (UXO) which is expensive to clean up. Pyrotechnic devices can also start range fires that destroy the environment and frequently cause the cessation of training exercises. The U.S. Army's current 40 mm M918 cartridge is an example of commonly used pyrotechnic training ammunition.

To prevent the generation of UXO and range fires during training, it is useful to develop inert practice ammunition projectiles which do not employ energetic pyrotechnics.

Nevertheless, good military training devices should simulate the effects of live fire high-explosive detonations. High explosive detonations in combat generate visual and near infra-red light and heat, forming a multi-spectral signature. High explosive detonations also produce smoke plumes. The light and heat resulting from high explosive detonations can be detected by an array of fire control devices used by the military. Smoke plumes are visible to the naked eye.

Military forces frequently use target locating devices with visual cameras and cameras that operate in the near and/or far IR spectrum. Accordingly it is desired that practice ammunition simulate the effects seen in combat and that practice ammunition generate multi-spectral marking signatures, upon impact, that can be viewed by these cameras.

Chemi-luminescent technology, such as that taught in the Haeselich U.S. Pat. No. 6,619,211, has been used to transmit visible energy to mark the trace and impact of practice ammunition. There are, however, certain drawbacks to this technology as currently practiced: (1) Chemi-luminescent materials do not work well at low temperatures, and (2) currently available chemi-luminescent materials do not generate enough heat to provide a good signature for thermal weapon sensors.

In the past, pyrotechnic devices have generally produced a smoke and heat plume that resulted from combustion of the pyrotechnic compounds. Also, ordnance designers have packaged visible marking materials, such as one simple buoyant marking material, inside of frangible ogives, to create visible marking plumes. This technology has been used, for example, in the U.S. Army's vintage M781 design. Rheinmetall GmbH & Co. (Germany) has developed ammunition like the MK281 MOD 0 which was introduced to United States forces in 2003. These M781 and MK281 designs have packaged a single buoyant marking material that generates a simple visual plume on impact.

It is important to recognize that military gunners often fire their weapons at long range in military training areas that include grass, vegetation and low lying trees. Hence, while there is some value to package and fire materials that directly mark a target (as is discussed, for example, in the Manole U.S. Pat. No. 7,055,438) the morphology and terrain on a military range frequently preclude gunners from having direct visibility of the actual impact point.

SUMMARY OF THE INVENTION

One objective of the present invention, therefore, is to provide a device that creates and optimizes marking plumes for practice ammunition that may be detected by military night vision and thermal sensors.

Another objective of the present invention is to provide a multi-spectral plume device for practice ammunition which creates a marking plume both in the proximity of, and above, the point of impact and is composed of materials that produce (1) a visible marking compound, (2) light in the visible, and near IR spectrum range, and (3) a heat signature in the far IR (thermal) spectrum range.

A still further objective of the present invention is to provide a device for practice ammunition that creates heat upon firing so as to heat the marking materials and optimize the light output, upon impact, in the visible and near IR spectral range.

These objectives, as well as further objectives which will become apparent from the discussion that follows, are achieved, according to the present invention, by providing a multi-spectral plume device that functions as follows: Upon setback, low density marking materials contained in a projectile are quickly heated by a novel heat engine during the short projectile flight. The materials remain housed in a frangible ogive and the temperature of the marking materials increases during flight. Phase change material absorbs excess heat that may be produced at higher ambient temperatures. The marking materials are arranged in a layered configuration that optimizes the upward ejection and flow of these materials upon impact with a hard surface, sand or soil. Upon impact, the ogive breaks and the marking materials are efficiently ejected and lofted into the air creating a plume of buoyant material that momentarily creates a shroud above a target. The materials include (1) reflective material coated with a dye that reflects light in daytime conditions, (2) visible and chemi-luminescent materials that, when mixed, emit light in the visual and near IR spectral range so that the plume is visible by the naked eye and with night vision devices. The plume materials, heated during flight to above ambient temperature, provide a thermal signature. The temperature difference produces a heat plume with contrast to the ambient background (sky or terrain) visible above the point of impact.

The materials in the plume, which may appear as a shroud with thermal or night vision equipment, include a high contrast powder dye and emits both light (visual and near IR) and heat above the point of impact. The heat emitted by the marking materials provides for an effective contrast against the ambient temperature background when viewed by thermal viewing devices. The chemi-luminescent light provides for a night and near IR signature. Materials in the dye provide for a visible plume in daytime when viewed with cameras or the human eye. By lofting a multi-spectral plume above a target, the gunners can better judge the accuracy of aim with such practice ammunition, and the points of impact can be readily seen by gunners and other participants in military training.

The present invention thus configures low density marking materials layered in a frangible ogive so that, on high speed impact, the materials are ejected and lofted into the air creating a buoyant plume visible on multi spectral imaging devices (visual cameras, image intensification devices and thermal arrays). Some or all of the marking materials remain aloft for several seconds above the point of impact providing good visual simulation of a high explosive detonation. The plume material gradually descends to the ground after impact but remains aloft for a sufficient length of time to allow gunners to observe and judge the distance and location of a target, even a target that may not be directly observable from a firing position. The multi-spectral plume thus clearly identifies the impact point of the projectile.

Set forth below are a series of terms used in this specification, together with an explanation of the meaning of each term in the context of the present invention.

Day Marking Material:

This material is a light, low density and fine material that has good fluid flow properties creating a material plume upon high speed impact.

Dyes:

Dyes are colored substances that have an affinity to the substrate to which they are applied. In the context of this invention, dyes may be used in both the chemical luminescent marker and the visual (day) marker to provide good visual signature, contrast and visibility of a plume material when viewed on a firing range.

Near Infrared or Chemical Luminescence Marker:

A substance similar to that used in commercially available "glowsticks" consists of two or more chemical agents that, when mixed, undergo a chemical reaction, emitting visible light that may be seen by the naked eye or by imaging devices under low light or nighttime conditions. Suitable chemi-luminescent agents are disclosed, for example, in U.S. Pat. No. 5,348,690. These materials may coat a light medium with good fluid flow properties, thereby allowing for effective dispersion and pluming after projectile impact.

Frangible Ogive:

Practice ammunition has a hood or cover over an ogive that, upon high-speed impact, bursts to release marking materials. The hood or cover retains structural integrity in handling and during projectile flight.

Heated Plume Materials:

The day-marking dye and night (near IR) chemical luminescent materials, when heated in flight, provide for a thermal signature (i.e., contrast with the background sky/atmosphere) that is easily distinguishable in thermal cameras from the ambient temperature of surrounding air and terrain. The heat radiates into the atmosphere and increases the relative buoyancy of the plume materials suspended in the cooler air.

Setback:

The instant a propellant in an ammunition cartridge ignites, and the expanding gases accelerate the projectile forward in the barrel, this initial acceleration (setback) breaks the seals between a compartment containing oxygen and a surrounding dry material that undergoes a thermite reaction upon exposure to oxygen creating heat. Simultaneously, the setback (and also the spin of the projectile) allows for mixing and activation of chemi-luminescent materials.

Mixing:

After setback, the projectile may undergo spin and deceleration (due to air resistance) that may further mix the chemi-luminescent liquids into a material medium.

Heat Engine:

In the context of the present invention, a "heat engine" comprises a solid oxidizing thermal fuel located in the projectile adjacent a breakable barrier with a container or void that contains air or oxygen. The heat engine functions to create heat due to a thermite reaction when the barrier is broken.

Thermite Reaction:

A termite reaction is an exothermic reaction caused by the exposure of a known family of materials to oxygen or air. Examples of liquid chemical components which, when mixed, create heat include: (1) hydration of anhydrous salts, for example water and anhydrous calcium chloride or copper sulfate; and (2) liquid components that create polymerization reactions, such as the catalyzed polymerization of monomethacrylate.

Atomization:

Atomization refers to the conversion of liquid into a spray or mist (i.e. collection of droplets). The term does not imply that the particles are reduced to atomic sizes. The process occurs when a chemi-luminescent liquid, a chemi-luminescent liquid coating a dry light medium (marker material), and/or fine marking materials (with visual dye) undergo a high speed impact which ejects the low density material into the atmosphere, retaining some relative buoyancy and being carried by the prevailing wind and slowly falling to the earth's surface.

Phase Change Material:

A material that undergoes a phase transformation from solid to liquid, or liquid to gas, at a desired temperature with predictable physical attributes is called a "phase change material". In the context of this invention, the phase change material (a) stores heat and (b) insures that the absolute temperature of plume material does not burn dyes or exceed the effective output temperature of chemi-luminescent marking materials. The phase change material has another safety purpose in insuring that the projectile's maximum temperature does not exceed a temperature that would badly burn human skin (e.g., when handling a cartridge after a misfire), or would inadvertently ignite a range fire.

Plume:

In the context of hydrodynamics and the present invention, a plume is a column of one or more buoyant marking materials and/or an atomized chemi-luminescent spray moving through the atmosphere in the vicinity of a target. Several effects control the motion of these materials: initial velocity, impact and ejection geometry, surface conditions, momentum of materials, diffusion of materials, heat difference of fluids (which varies by flight time of the projectile), and relative buoyancy of the material ejected into a plume. These factors affect the plume's duration, height and visibility. Winds at the point of impact may move the plume to simulate the smoke and burnt energetic materials resulting from live detonating ammunition.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
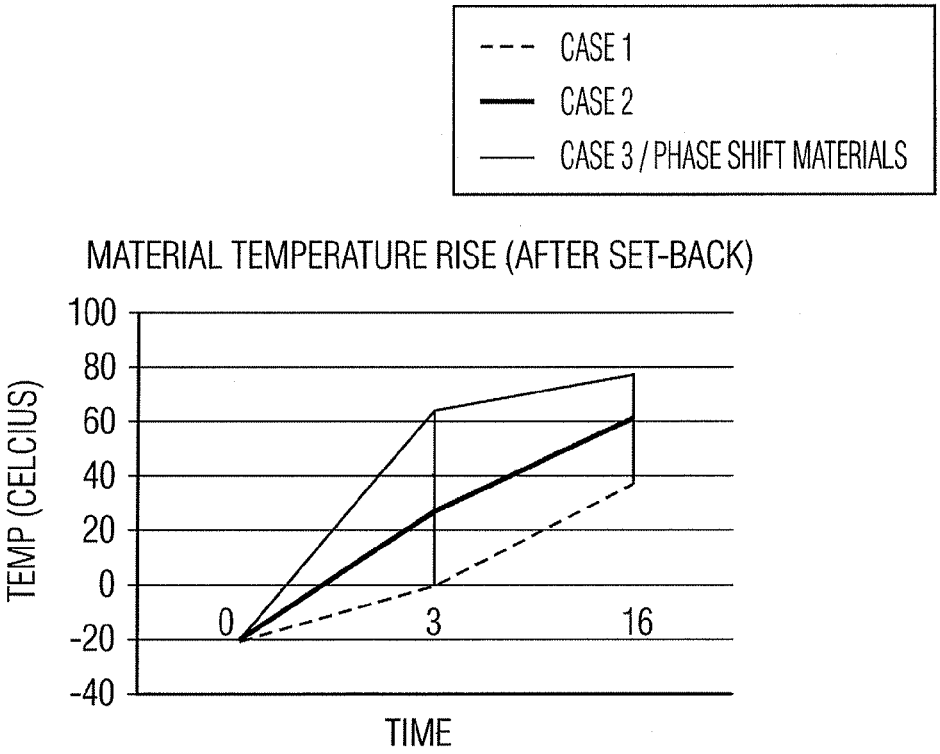
FIG. 1 is a time/temperature diagram showing the temperature rise, during flight, of plume materials caused by a "heat engine" in a practice ammunition projectile according to the present invention.

The preferred embodiments of the present invention will now be described with reference to FIGS. 1-7 of the drawings. Identical elements in the various figures are designated with the same reference numerals.

The present invention combines known and novel methods of developing practice ammunition that generates a visible, near infrared and far infrared marking plume above the location of a projectile impact. In addition to combining these marking technologies, this invention provides a heat engine for creating optimized performance characteristics exceeding the stand-alone performance of the individual constituents.

This disclosure assumes a prior knowledge and use of some means and methods described in the Haeselich U.S. Pat. No. 6,619,211 and U.S. Patent Publication No. 2007/0119329 A1, the disclosures of which are incorporated herein by reference. Both the chemi-luminescent reaction and thermal reaction of the materials used in the projectile according to the present invention are activated by setback.

All projectiles derive some heat from firing from a gun barrel providing visibility in flight of a projectile body; however, the body does not normally rapidly or effectively transfer heat to marking materials. To provide a good marking signature with oblique angle impacts on military ranges, the materials, housed in a frangible ogive on the practice ammunition, must be configured for ejection and good hydrodynamic flow. A proper configuration allows for immediate development of a material plume over the point of impact after the projectile impact with a target. The post impact plume, resulting from the present invention, provides for a multi-spectral shroud, remaining suspended in the atmosphere moments after impact. A good realistic impact signature for military training ammunition normally includes a plume that replicates a high explosive detonation of operational ammunition.

Multi-Spectral Plume and Signature Simulates a Live Detonation:

The plume resulting from use of a practice projectile according to the present invention has characteristics that closely simulate the signature of a high explosive detonation. To create a multi-spectral marking signature visible from a firing position, it is desirable to incorporate into a practice projectile multiple low density marking materials that readily flow and atomize. These marking materials, upon impact, are ejected from a burst ogive at the nose of the projectile. The materials flow from the ogive, but subsequently decelerates due to the effect of air resistance. The effective flow of materials generates a plume of materials. The materials suspended in the plume (1) provide a reflective signature in the visual (day) conditions, (2) generate chemi-luminescent light at night (both in the visible and the near IR spectrum), (3) further heat suspended material, and (4) emit heat in a manner that has a good thermal contrast against the colder atmosphere and terrain in the vicinity of an impact. It is desirable to optimize laminar flow and minimize turbulence to insure that a plume reaches an optimum altitude above an impact point to provide good visibility from a firing point.

Impact, Ejection, Laminar Flow of Marking Materials and Use of Low Density Material to Optimize Plume Suspension in the Air:

To create an effective plume, a practice projectile should allow for laminar flow of ejected materials and minimum post impact turbulence. To optimize a plume and laminar material flow, a practice projectile design should preferably be configured with the marking materials in the projectile ogive disposed in layers stored in separate compartments. This layering packaging technique allows the materials to atomize and flow effectively when it undergoes a high-speed impact and ejection. To sustain suspension in the air, the ejected marking materials are composed of low-density materials that retain relative buoyancy in the air. This relative buoyancy of marking material allows the marking materials to remain suspended in the atmosphere and carried by winds at the target location. The technique of maximizing a suspension of a plume of multiple materials provides for visual, IR and thermal signatures. Such a projectile's marking signatures and plume closely replicate the visual, IR and thermal impact signatures and smoke clouds that result from high explosive detonations on targets. An actual impact detonation occurs in a few milliseconds, whereas the plume created by high-speed impact occurs in a much longer time frame (tens of milliseconds). The difference in creation of a visual signature is imperceptible, however, except in the most unusual circumstances.

Enhanced Chemi-Luminescent Effect:

It is possible to heat all marking materials (visual day, and near IR chemi-luminescent) by transmitting heat via a conductive heat sink from one compartment, where oxygen and a thermite type powder react, to other compartments so that the heat sink quickly imparts heat to all marking compounds contained in the projectile. The magnitude of light output from a chemical luminescence reaction increases in intensity when chemi-luminescent materials are exposed to heat. Brighter luminescence provides greater contrast to the surroundings and may be more readily identified at longer range. Further, accelerated chemi-luminescent reactions speed the dissipation of a chemi-luminescent signature so that the visual signature better replicates the signature of a high explosive detonation. Therefore, the shorter duration allows the signature to better approximate the signature of live ammunition. At temperatures approaching −20° C., the luminescence reaction rate slows or stops, rendering it ineffective. Use of this technique increases the operating range of chemi-luminescent materials, allowing for use of chemi-luminescent day and night markers in low temperature conditions.

Heated Marking Plume:

Far Infrared (thermal) marking is created by heating a marking material to temperatures greater than their surroundings. A large temperature difference between a plume of day (dry powder) and night (chemi-luminescent) marking materials provides both a "brighter" signature viewed by visual and/or near IR devices and, in parallel, provides for heat contrast between plume material and ambient air when viewed by thermal viewing devices. A 20° C. temperature differential between the thermal marker and its surroundings provides an effective contrast.

Quick Heating Transmission during Projectile Fight:

It is important that heat be quickly imparted to the marking materials in a projectile so that the temperature of the marking materials rises quickly during the short flight time. This is necessary as projectiles may be fired at short range during training. To provide for a good thermal signature in a material plume, a device in the projectile (the heat engine) must quickly transfer heat to marking materials so that, on post impact, the plume provides a visible contrast with the ambient atmosphere or terrain in the background. It is also useful that the temperature of the marking materials rises during flight to counteract the reduced transmission of a heat (thermal) signature to an observer at the firing point when firing at longer distances. A hotter material plume is particularly visible (in contrast to the cooler ambient sky) when firing extended distances.

Limiting Maximum Temperature:

The heat engine device preferably includes a phase change material insuring that additional thermal energy does not increase beyond a given maximum temperature of a projectile. It is desirable to limit the maximum temperature of the marking materials so that, in the event of an inadvertent activation of the heat engine during weapons handling, a gunner can clear the weapon without incurring severe burns. The inclusion of a phase change material can also provide for more uniform distribution of heat within the marking materials.

FIG. 1 is a chart showing the rise in material temperature during the flight of 40 mm HV a Ammunition. This temperature rise is shown for three cases: Case 1 representing the lowest temperature rise in the plume material; Case 2 representing a medium temperature characteristic; and Case 3 representing the most aggressive material temperature rise. In Case 3, a phase change material permits an initial rapid rise in temperature and thereafter, due to a phase change, maintains a substantially stable temperature. These characteristics are summarized in the following Table:

TABLE

| Range or Distance (meters) to impact<br>Time (seconds) | 0 m<br>0 s | 550 m<br>3 s | 1450 m<br>16 s |
|---|---|---|---|
| (Plume) Material Temp-Case 1 | −20° C. | 0° C. | 38° C. |
| Material Temp-Case 2 | −20° C. | 28° C. | 62° C. |
| Material Temp-Case 3/Phase change Materials | −20° C. | 65° C. | 78° C. |

Desired Operating Temperatures:

The desired ambient temperature for operation of the heat engine device is considered to be in the range of −20° C. to 50° C. The ideal device would reach the optimal temperature range of the near infrared marker material immediately after setback, sustain this temperature for the full flight time of the projectile and transfer all of its thermal energy via the marking materials before reaching the point of impact. Ideal performance is additionally constrained by the maximum temperature of the near infrared marker with a desire for low manufacturing cost.

The Manole Patent:

The Manole U.S. Pat. No. 7,055,438 teaches the use of liquids (water and salts) to create a heat reaction to heat projectiles in flight and mark a point of impact (on a solid surface). Manole further discloses projectile materials directly marking a target on impact. It is, however, important to note that marking a target (hitting a vertical target visible from an observation point) with a marking dye is not the same as providing a vertical plume signature when striking targets at oblique angles. Often military machine gun training ranges do not provide vertical targets and, when such targets are available, they may be impossible to view from an observation point.

It should also be noted that it is nearly impossible to retain good projectile flight ballistics when using liquids in a projectile. United States military requirements emphasize the need for a ballistic match of operational and training ammunition.

The present invention thus provides a training projectile that:

Uses a dry thermite type material that, when exposed to oxygen encapsulated in the projectile, rapidly heats a metal surface (heat sink) that, in turn, rapidly conducts (transmits) heat to marking materials that plume on impact in the vicinity of a target.

Uses a phase change material which insures that the transmission of heat (in a warmer ambient environment) does not burn, destroy or otherwise render ineffective the marking compounds, chemi-luminescent materials and dyes.

Results in a short, quick and intense temperature rise.

Does not use a reaction of liquid chemicals to heat a projectile. By minimizing liquids carried by the training projectile, the projectile offers ballistic characteristics similar to those of conventional, operational ammunition.

Effectively provides for heat transfer to marking materials that subsequently create a plume on impact.

Provides for optimized ejection (laminar flow of marking materials) to create and optimize creation of a post impact plume above a target.

First Preferred Embodiment of the Invention

Figure 2:
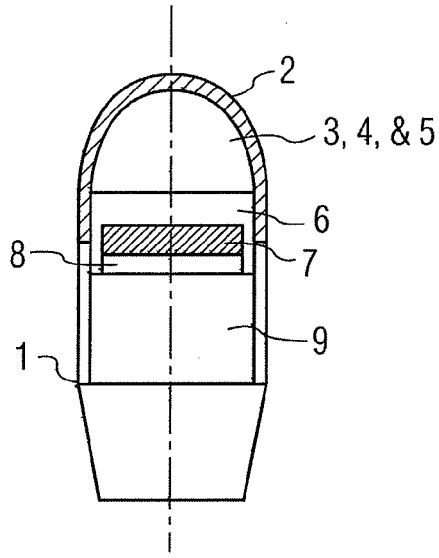
FIG. 2 is a representational diagram of a practice ammunition projectile according to a first preferred embodiment of the present invention.

The practice ammunition projectile according to a first preferred embodiment of the present invention, as depicted in FIG. 2, is comprised of the following elements:

A projectile body 1.

A frangible hood or ogive 2 (as described, for example, in the U.S. Pat. No. 6,619,211) containing a plurality of marking agents, such as the following:

A visible dry powder marker 3.

A near infrared and/or visual chemical luminescence marker 4.

A far infrared or thermal marker 5.

According to the invention, the projectile body incorporates a "heat engine" comprising:

A heat transfer boundary 6.

A solid oxidizing thermal fuel 7, typically formed from metals or metallic powders that, when exposed to air or oxygen, creates an exothermic thermite or similar reaction.

A breakable oxygen or air barrier 8.

A void 9 containing oxygen or air.

Figure 6:
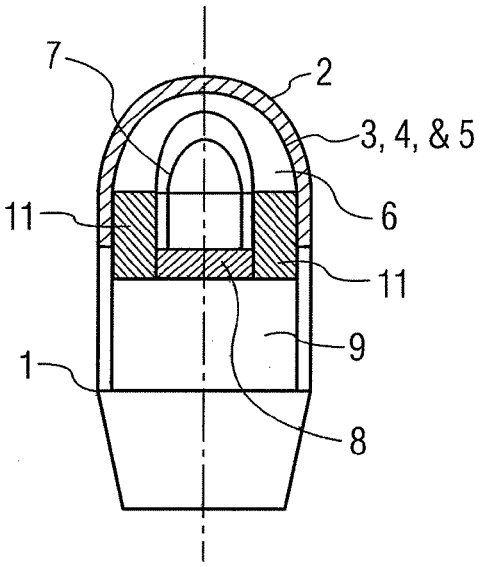
FIG. 6 is a representational diagram of a practice ammunition projectile according to a second preferred embodiment of the present invention.
Figure 7:
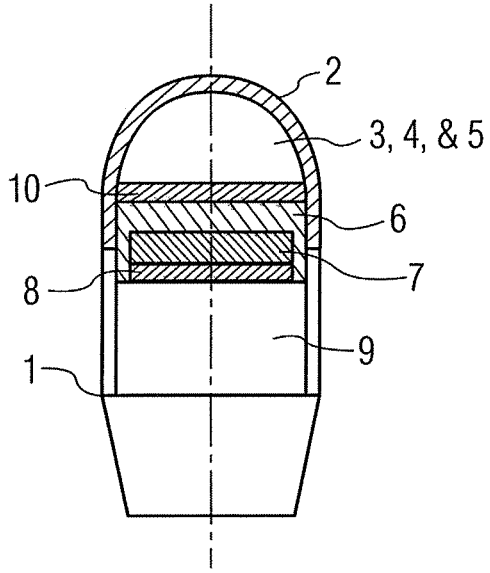
FIG. 7 is a representational diagram of a practice ammunition projectile according to a third preferred embodiment of the present invention.

The following additional elements contained in the projectile body are shown in FIGS. 6 and 7:

A phase change material 10.

A heat sink 11 or other means for thermal distribution and management in the projectile.

Figure 3:
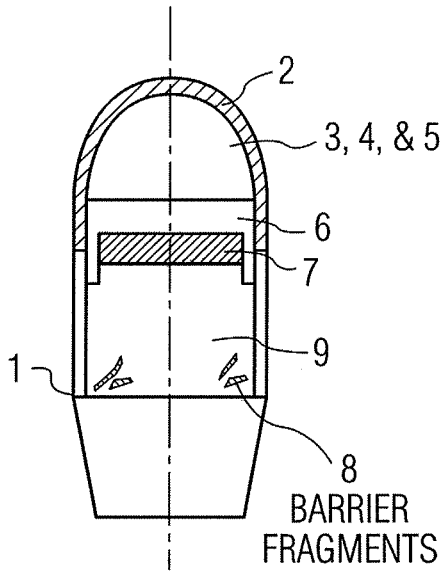
FIG. 3 is a representational diagram of the practice ammunition projectile of FIG. 2, immediately after setback.

Operation of the Training Projectile:

Step 1. As shown in FIG. 3, the barrier 8 breaks on setback shock or due to forces from vertical or rotational acceleration allowing oxygen or air to react with the thermal fuel material 7 initiating an exothermic reaction. The volume and composition of fuel material is selected to provide the desired heat profile (FIG. 1).

Figure 4:
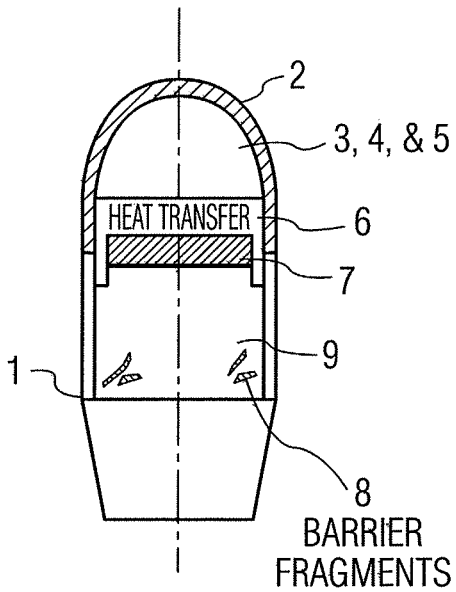
FIG. 4 is a representational diagram of the practice ammunition projectile of FIG. 2, during flight toward a target.

Step 2. As shown in FIG. 4, heat is transferred across the boundary 6 to the marking materials 3, 4 and 5 at a rate dependent upon the temperature of the xothermic reaction, the heat capacity of the fuel material 7, the geometric configuration of the thermal barrier boundary 6 and the thermal properties of the marker materials 3, 4 and 5.

Step 3.

As indicated in FIG. 4, heat is transferred during flight to the marking materials, raising their temperature. The increased temperature of the near infrared marking materials results in increased brightness of a chemi-luminescent mix and improved performance at lower ambient starting temperatures.

Step 4.

Figure 5:
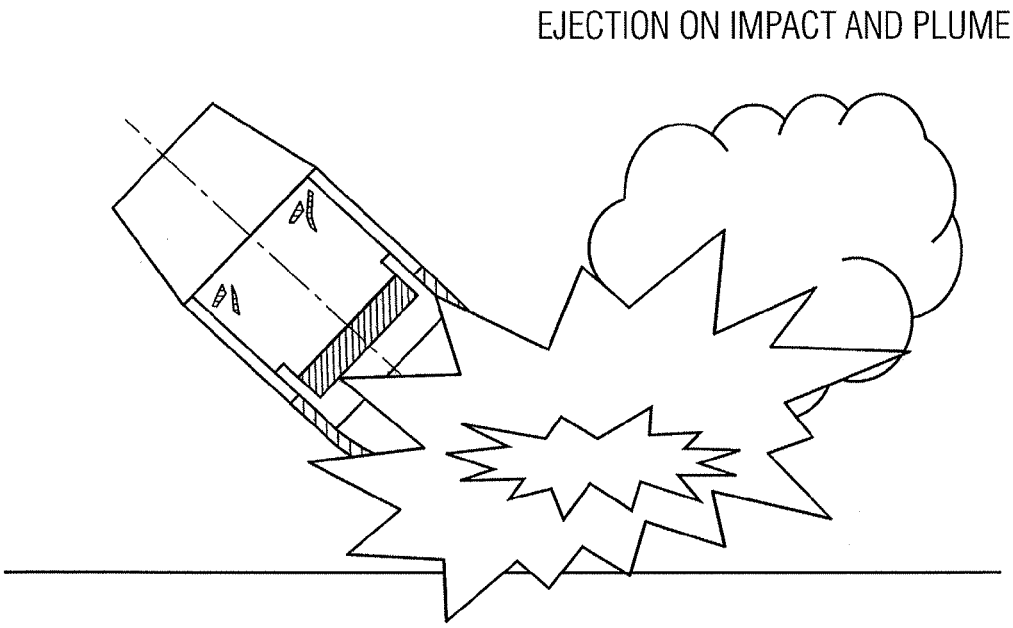
FIG. 5 is a representational diagram of the practice ammunition projectile of FIG. 2, upon impact with a target.

As shown in FIG. 5, the frangible ogive bursts and the marking materials plume into the air and also coat the surface area of material, vegetation and grass surrounding the point of impact. The resulting plume and coating provide simultaneous marking in a multiple spectrum (visible, near infrared and far infrared).

Two alternate embodiments may be used to enhance the overall performance making the device more effective in a broader range of ambient conditions. These embodiments may be used separately or in conjunction, as required, to balance the performance and cost constraints of the training ammunitions.

Second Preferred Embodiment

One of many alternate geometries configured to enhance the thermal characteristics of the device is depicted in FIG. 6. In this geometry, improved thermal characteristics and a more uniform heat distribution are achieved by creating a more uniform heat distribution by creating a custom heat generation profile through shaping of the thermal engine and optionally inserting heat sinks 11. The rate of temperature increase, peak temperature and sensitivity to external ambient conditions can be adjusted using such techniques.

Third Preferred Embodiment

The thermal characteristics may be further enhanced through the introduction of a phase change material. Phase change material 10 may be introduced either as an additional layer on the surface of the heat transfer boundary, on the inner surface of the frangible ogive, or directly in the bulk mixture of the marking materials. FIG. 7 illustrates one possible option in the form of a thin film coating the heat transfer boundary. Once the phase change material reaches its melting temperature it will absorb large amounts of heat while maintaining a constant temperature at its melting point. This allows a rapid transfer of thermal energy to create a liquid thermal marking material while preventing excess temperature of the other marking constituents.

There has thus been shown and described an improved projectile with a multi-spectral marking plume which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A training ammunition projectile comprising a hollow projectile body with a projectile head, designed to withstand the forces applied when the projectile is fired from a weapon and having a frangible ogive designed to burst when the projectile body strikes a target, said projectile further comprising:

(a) a multi-spectral marking agent disposed in the head for marking the position of the target upon release when the ogive has burst upon impact with the target, said marking agent comprising at least one of:

(1) a plurality of first liquid chemical components each received in separate first frangible compartment in the head, said first components being mixed and reacting chemically with each other when the compartments break, causing the mixed components to luminesce, said compartments being designed to be broken by at least one of the initial acceleration and the centrifugal forces acting on the projectile when the projectile is fired from a weapon, while retaining the first chemical components in the ogive so that such components are mixed at the time the projectile is fired from a weapon and luminesce by the time the projectile strikes the target; and (2) a low density, fine, dry powder material disposed in the head and designed to create a plume for visible marking of the target upon impact; and (b) a dry, oxidizing, non-pyrotechnic thermal material disposed in a second compartment in the projectile body having a frangible barrier wall designed to be broken due to at least one of the initial acceleration and the centrifugal forces acting on the projectile when the projectile is fired from a weapon, exposing the thermal material to at least one of oxygen and air in the projectile body and producing an exothermic reaction that emits heat during flight of the projectile, thereby to increase the temperature of said marking agent during flight and to create a plume for Infrared marking of the target upon impact.

2. The training projectile defined in claim 1, wherein the marking agent includes both (1) the first liquid chemical components and (2) the dry powder material for marking the target.

3. The training projectile defined in claim 1, wherein said marking agent further includes a plurality of second chemical components each received in a separate second compartment in the head, said second components being mixed and reacting chemically with each other, due to at least one of the initial acceleration and the centrifugal forces acting on the projectile, when the projectile is fired from a weapon, causing the mixed second components to create heat for thermally marking the target when the projectile strikes the target.

4. The training projectile defined in claim 1, further comprising a carrier medium containing oxygen disposed in a further, separate compartment in the head which is designed to be opened, and allow the carrier medium to mix with the thermal material, upon at least one of the initial acceleration and the centrifugal forces acting on the projectile when the projectile is fired from a weapon, thereby causing the thermal material to react and create heat.

5. The training projectile defined in claim 4, wherein said carrier medium is a gas which includes oxygen.

6. The training projectile defined in claim 1, further comprising a third material component, disposed in a third compartment in the head, designed to undergo a phase change at a prescribed temperature, said third component serving to absorb heat at said prescribed temperature and thereby prevent overheating of the marking projectile and the marking agent.

7. The training projectile defined in claim 1, wherein said dry powder material and dry thermal material are arranged in layers in said head.

8. The training projectile defined in claim 1, further comprising a phase change material disposed within the projectile body for preventing excess temperature of the marking agent, said phase change material being operative to melt and absorb thermal energy during flight of the projectile.

9. The training projectile defined in claim 1, further comprising at least one heat sink disposed within the projectile body for moderating the temperature and creating a more uniform heat distribution therein.

* * * * *